US008313562B2

(12) United States Patent
Shecterle et al.

(10) Patent No.: US 8,313,562 B2
(45) **Date of Patent: *Nov. 20, 2012**

(54) APPARATUS AND PROCESS FOR ISOMERIZING A HYDROCARBON STREAM

(75) Inventors: David J. Shecterle, Arlington Heights, IL (US); Bryan S. Garney, Crystal Lake, IL (US); Jocelyn C. Daguio, Chicago, IL (US); James M. Shawley, Clarkston, WA (US)

(73) Assignee: UOP LLC, Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/223,694

(22) Filed: Sep. 1, 2011

(65) Prior Publication Data

US 2011/0309299 A1 Dec. 22, 2011

Related U.S. Application Data

(62) Division of application No. 12/485,246, filed on Jun. 16, 2009.

(51) Int. Cl.
*C09F 9/00* (2006.01)

(52) U.S. Cl. ..... 95/121; 95/117; 95/123; 95/126; 95/148; 208/133; 96/108; 96/150

(58) Field of Classification Search ..... 208/133–141, 208/187–188; 95/90, 117, 121, 123, 126, 95/148; 96/108, 150

See application file for complete search history.

(56) References Cited

U.S. PATENT DOCUMENTS 5,264,187 A * 11/1993 Olbrich et al. ..... 422/612

* cited by examiner

*Primary Examiner* — Brian McCaig
(74) *Attorney, Agent, or Firm* — Maryann Maas

(57) ABSTRACT

One exemplary embodiment can be an apparatus for isomerizing a hydrocarbon stream rich in a C4 hydrocarbon and/or at least one of a C5 and C6 hydrocarbon. The apparatus can include: a first drier and a second drier adapted to receive a fluid including at least one reactant; and a reaction zone communicating with the first drier to receive the fluid including at least one reactant and with the second drier to receive the regenerant. Generally, the first drier operates at a first condition to dry the fluid including at least one reactant and the second drier operates at a second condition during regeneration with a regenerant. The regenerant can pass through a fluid tapering device for regulating the flow of the regenerant to the reaction zone.

5 Claims, 3 Drawing Sheets

APPARATUS AND PROCESS FOR ISOMERIZING A HYDROCARBON STREAM

CROSS REFERENCE TO RELATED APPLICATION

This application is a Division of copending application Ser. No. 12/485,246 filed Jun. 16, 2009, the contents of which are hereby incorporated by reference in its entirety.

FIELD OF THE INVENTION

The field of this invention generally relates to an apparatus and a process for isomerizing a hydrocarbon stream.

DESCRIPTION OF THE RELATED ART

Isomerization of light paraffins is often conducted to increase the octane content of gasoline. Generally, such isomerization processes are conducted on separate light hydrocarbon fractions. As an example, isomerization of butane, or pentane and/or hexane (hereinafter may be abbreviated pentane-hexane) is undertaken in separate isomerization units to improve the gasoline quality. Typically, both the isomerization of butane or pentane-hexane are conducted in a fixed-bed liquid/vapor phase or vapor phase process. The reactor can receive a feed of the light paraffins mixed with a gas including a substantial amount of hydrogen.

In the isomerization of butane or pentane-hexane, water is a poison that can reduce the life expectancy of the reactor catalyst. As such, it is desirable to remove water before the hydrogen rich gas and/or the paraffin feed reaches the reactor. Consequently, typically both the feed and the gas are passed through separate drier units to remove water.

Often, two driers are utilized in either series or parallel with alternating regeneration operations, whether the fluid being processed is a gas rich in hydrogen or a hydrocarbon containing butane or pentane-hexane. As such, one drier can be in operation while the other drier may be regenerating. At the end of the regeneration, the drier can contain a gas regenerant if the drier is a gas drier, or a liquid regenerant if the drier is a hydrocarbon feed drier. Depending on the hydrocarbon fraction being isomerized, the regenerant can include mostly an isomerized product, such as isobutane, or at least one of isopentane and isohexane (hereinafter may be referred to as isopentane-isohexane); or the regenerant can include a mixture of one or more different branched, normal, and cyclic compounds. In either instance, generally the regenerant is flushed out of the drier before or as the regenerated drier enters into service. The regenerant is often passed to the reactor.

The regenerant, whether liquid or gas, can cause upsets in the downstream vessels. Particularly, the gas regenerant can cause a drop in reaction temperatures as the regenerant replaces the hydrogen used in the reactor, and disrupts the hydrogen:hydrocarbon mole ratio in the reactor. Also, a liquid regenerant can cause a drop in reactor temperatures by replacing at least one reactant, namely the paraffinic hydrocarbon feed. In addition, generally the gas regenerant has a heavier molecular weight than the hydrogen rich gas. As a consequence, replacing the hydrogen rich gas may upset the gas flow controls, such as the make-up gas flow, as well as disturbing the pressure controls in a distillation column, which is typically used downstream of the reactor. Thus, there is a desire to lessen the impact after the regeneration either of the gas or feed drier to prevent upsets of the downstream vessels.

SUMMARY OF THE INVENTION

One exemplary embodiment can be an apparatus for isomerizing a hydrocarbon stream rich in a C4 hydrocarbon and/or at least one of a C5 and C6 hydrocarbon. The apparatus can include: a first drier and a second drier adapted to receive a fluid including at least one reactant; and a reaction zone communicating with the first drier to receive the fluid including at least one reactant and with the second drier to receive the regenerant. Generally, the first drier operates at a first condition to dry the fluid including at least one reactant and the second drier operates at a second condition during regeneration with a regenerant. The regenerant can pass through a fluid tapering device for regulating the flow of the regenerant to the reaction zone.

Another exemplary embodiment can be a process for regenerating at least one drier for an apparatus for isomerizing a hydrocarbon stream rich in a C4 hydrocarbon and/or rich in at least one of a C5 and C6 hydrocarbon. The process can include: regenerating the at least one drier using a regenerant fluid; and diluting the used regenerant downstream of the at least one drier over a period of time with a dried fluid including a reactant to minimize upsets in downstream operations.

Yet another exemplary embodiment can be a process for regenerating at least one drying zone for an apparatus isomerizing a hydrocarbon stream. The process can include diluting a used regenerant rich in a C4 hydrocarbon and/or rich in at least one of a C5 and C6 hydrocarbon downstream of the at least one drying zone over a period of time with a dried reactant fluid to minimize upsets in one or more downstream operations.

Therefore, the embodiments disclosed herein can minimize upsets in operations downstream of a fluid drying zone by diluting a used regenerant downstream of the drying zone. The used regenerant may be passed through a fluid tapering device to permit dilution of the used regenerant with a dried fluid.

DEFINITIONS

As used herein, the term "stream" can be a stream including various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the hydrocarbon molecule. In addition, the term "Cn-Cn+1 hydrocarbon," such as "C5-C6 hydrocarbon," can mean at least one of a C5 and C6 hydrocarbon.

As used herein, the term "zone" can refer to an area including one or more equipment items and/or one or more sub-zones. Equipment items can include one or more reactors or reactor vessels, heaters, separators, exchangers, pipes, pumps, compressors, and controllers. Additionally, an equipment item, such as a reactor, drier or vessel, can further include one or more zones or sub-zones. It should be understood that each zone can include more equipment and/or vessels than depicted in the drawings.

As used herein, the term "fluid tapering device" generally means a device that at least directly or indirectly regulates the flow or reduces the pressure of a fluid. Generally, a fluid tapering device reduces a fluid flow as compared to its absence in e.g., a line, and may throttle a flow of fluid, as opposed to isolating the fluid. An exemplary fluid tapering device can include a restriction orifice or a controller such as a pressure differential indicating controller, a pressure indicating controller, a flow indicating controller, a flow indicator or a pressure indicator, typically acting in concert with one or more other devices, such as a control valve or a restriction orifice. Exemplary fluid tapering devices can include a combination of two or more components such as a restriction orifice, a flow indicator, a pressure differential indicating controller, and a control valve; or a flow indicating controller and a control valve acting in concert. The fluid tapering device can be installed on one or more lines to alter fluid flow or reduce pressure.

As used herein, the term "fluid transfer device" generally means a device for transporting a fluid. Such devices include pumps typically for liquids, and compressors typically for gases.

As used herein, the term "rich" can mean an amount generally of at least about 50%, and preferably about 70%, by mole, of a compound or class of compounds in a stream.

As used herein, the term "substantially" can mean an amount generally of at least about 90%, preferably about 95%, and optimally about 99%, by mole, of a compound or class of compounds in a stream.

As used herein, the term "absorption" can refer to the retention of a material in a bed containing an absorbent and/or adsorbent by any chemical or physical interaction between a material, such as water, and the bed, and includes, but is not limited to, absorption, and/or adsorption. The removal of the material from an absorbent may be referred to herein as "desorption."

As used herein, the term "used regenerant" can refer to a regenerant that has been used for drying or desorbing, or that has been circulated through one or more vessels or equipment items, such as a drier. A used regenerant may or may not have desorbed a material, such as water, but may be present in a vessel after the vessel contents, such as a molecular sieve, have been regenerated.

As used herein, the term "coupled" can mean two items, directly or indirectly, joined, fastened, associated, connected, or formed integrally together either by chemical or mechanical means, by processes including stamping, molding, or welding. What is more, two items can be coupled by the use of a third component such as a mechanical fastener, e.g. a screw, a nail, a staple, or a rivet; an adhesive; or a solder.

DETAILED DESCRIPTION

Figure 1:
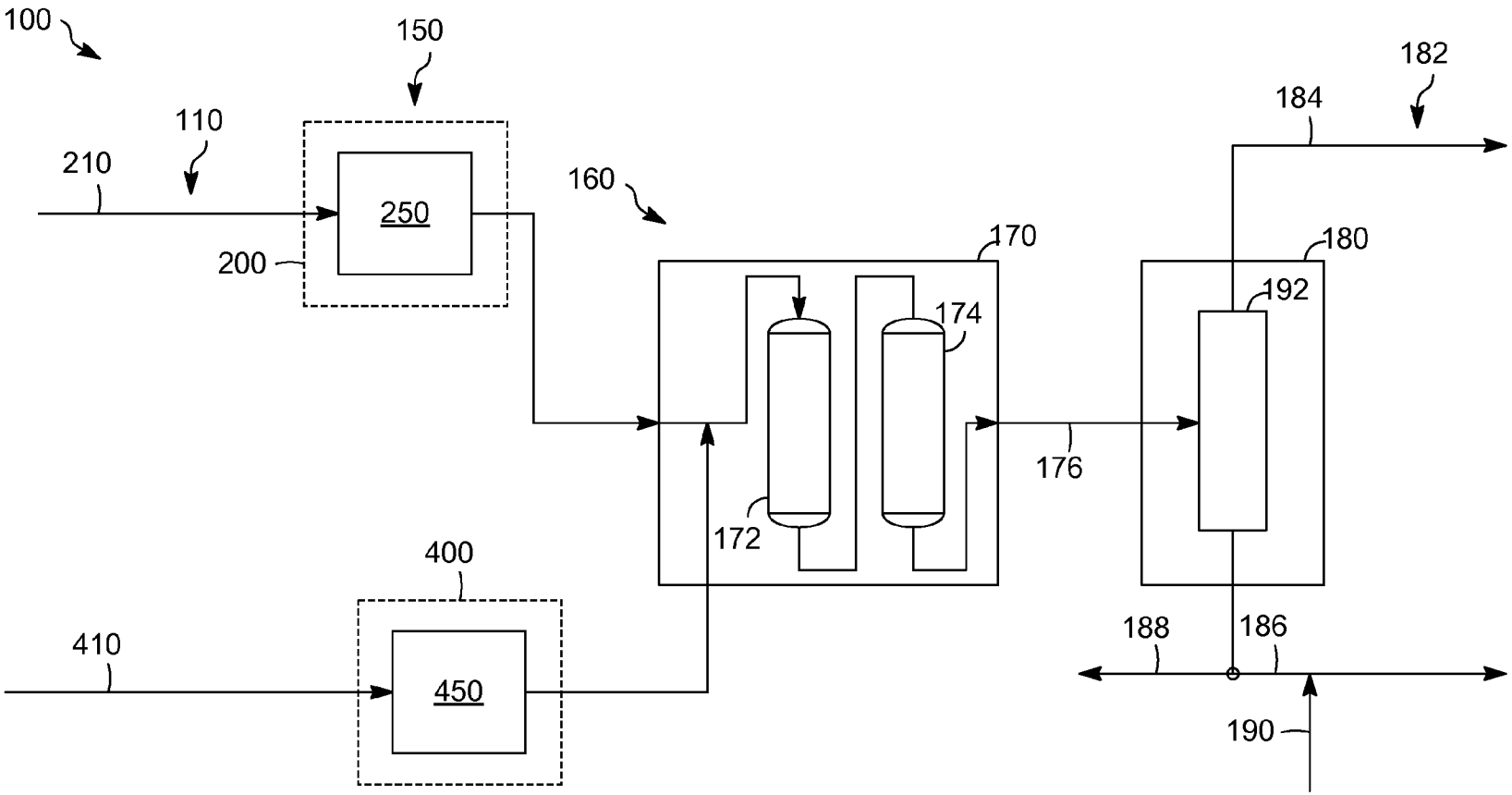
FIG. 1 is a schematic depiction of an exemplary apparatus for isomerizing a fluid.

An apparatus 100 for isomerizing a hydrocarbon stream is depicted in FIG. 1. Generally, the apparatus 100 can receive a fluid including at least one reactant 110 in either a line 210 or a line 410. Usually, the fluid 110 can be a liquid hydrocarbon stream in the line 210 or a gas rich in hydrogen in the line 410. The liquid hydrocarbon stream can be rich in a C4 hydrocarbon, such as butane, if the apparatus 100 is a C4 isomerization apparatus. Alternatively, the liquid hydrocarbon stream can be rich in a C5-C6 hydrocarbon, such as pentane-hexane, if the apparatus 100 is a C5-C6 isomerization apparatus. Exemplary apparatuses of both types are disclosed in, e.g., Nelson A. Cusher, *UOP Butamer Process* and *UOP Penex Process* of the Handbook of Petroleum Refining Processes, Third Edition, Robert A. Meyers, Editor, 2004, pp. 9.7-9.27. However, the apparatus 100 may also be utilized for simultaneously isomerizing a stream of one or more butanes, one or more pentanes, and one or more hexanes in some exemplary embodiments. Note that the isomerization reactions include those having largely normal paraffins as feedstock and branched paraffins as isomerate product as well as those having largely branched paraffins as feedstock and normal paraffins as isomerate product. In other words, the liquid hydrocarbon stream can be rich in isobutane or branched C5-C6 hydrocarbon. Other isomerization reactions involving the C4 or C5-C6 hydrocarbons are within the scope of the invention as well.

To simplify the discussion below, terms such as "liquid hydrocarbon" and "regenerant" may be referred to generically and should be understood to be applicable to, e.g., either a C4 isomerization apparatus or a C5-C6 isomerization apparatus. As an example, a hydrocarbon stream rich in a C4 hydrocarbon can be isomerized in a C4 isomerization reactor and an isomerized C4 hydrocarbon product can be used as a regenerant in a C4 isomerization apparatus. Likewise, a hydrocarbon stream rich in a C5-C6 hydrocarbon can be isomerized in a C5-C6 isomerization reactor, and an isomerized C5-C6 hydrocarbon product can be used as a regenerant in a C5-C6 isomerization apparatus. However, it remains within the scope of the invention to use a regenerant stream from one or more different locations of the isomerization process such as the from a fractionation zone, from driers, or perhaps even from a location external to the isomerization process. Nitrogen, for example, from a source external to the isomerization process may be used as the regenerant.

The apparatus 100 can include one or more drying zones 150, such as a liquid drying zone 250 and a gas drying zone 450, and one or more downstream operations 160, such as a reaction zone 170 and a fractionation zone 180. The liquid drying zone 250 can be comprised in a first fluid drying unit 200, and the gas drying zone 450 can be comprised in a second fluid drying unit 400. The units 200 and 400 are discussed in further detail hereinafter. The liquid drying zone 250 can receive a liquid hydrocarbon stream from the line 210, and the gas drying zone 450 can receive a gas rich in hydrogen from the line 410. Although not shown, it should be understood that fluid transfer devices, such as pumps and compressors, can be used to transport, respectively, the hydrocarbon liquid stream and the gas rich in hydrogen. Alternatively, either fluid can be of sufficient pressure so as to not require such devices. After exiting the drying zones 250 and 450, the liquid hydrocarbon stream and the gas rich in hydrogen may be combined downstream of the drying zones 250 and 450 in, e.g., the reaction zone 170.

The one or more downstream vessels 160 can be segregated into the reaction zone 170, which can include a first reactor 172 and a second reactor 174 in series with the first reactor 172, and the fractionation zone 180, which can include one or more distillation columns 192. Although only the first reactor 172 and second reactor 174 are depicted, it should be understood that the reaction zone 170 can further include other equipment or vessels, such as one or more heaters, a recycle gas compressor, a separator vessel, and additional reactors. Alternatively, the reactors 172 and 174 can be placed in single operation. An effluent from the reaction zone 170 can pass through a line 176 to the fractionation zone 180.

The fractionation zone 180 can include one or more distillation columns 192. Although one distillation column 192 is depicted, two or more distillation columns may be operated in series and/or in a parallel. The distillation column 192 can produce one or more separated products 182, such as a first product of one or more gas products routed to, e.g., fuel gas, in a line 184 and a second product or isomerized product in a line 186. A portion of the second product can be withdrawn through a line 188 and used as a regenerant. Used regenerant can be returned to the isomerized product in a line 190, as hereinafter described. The combined stream can be sent to an isomerized product storage tank, a distillation column, or another process unit.

Figure 2:
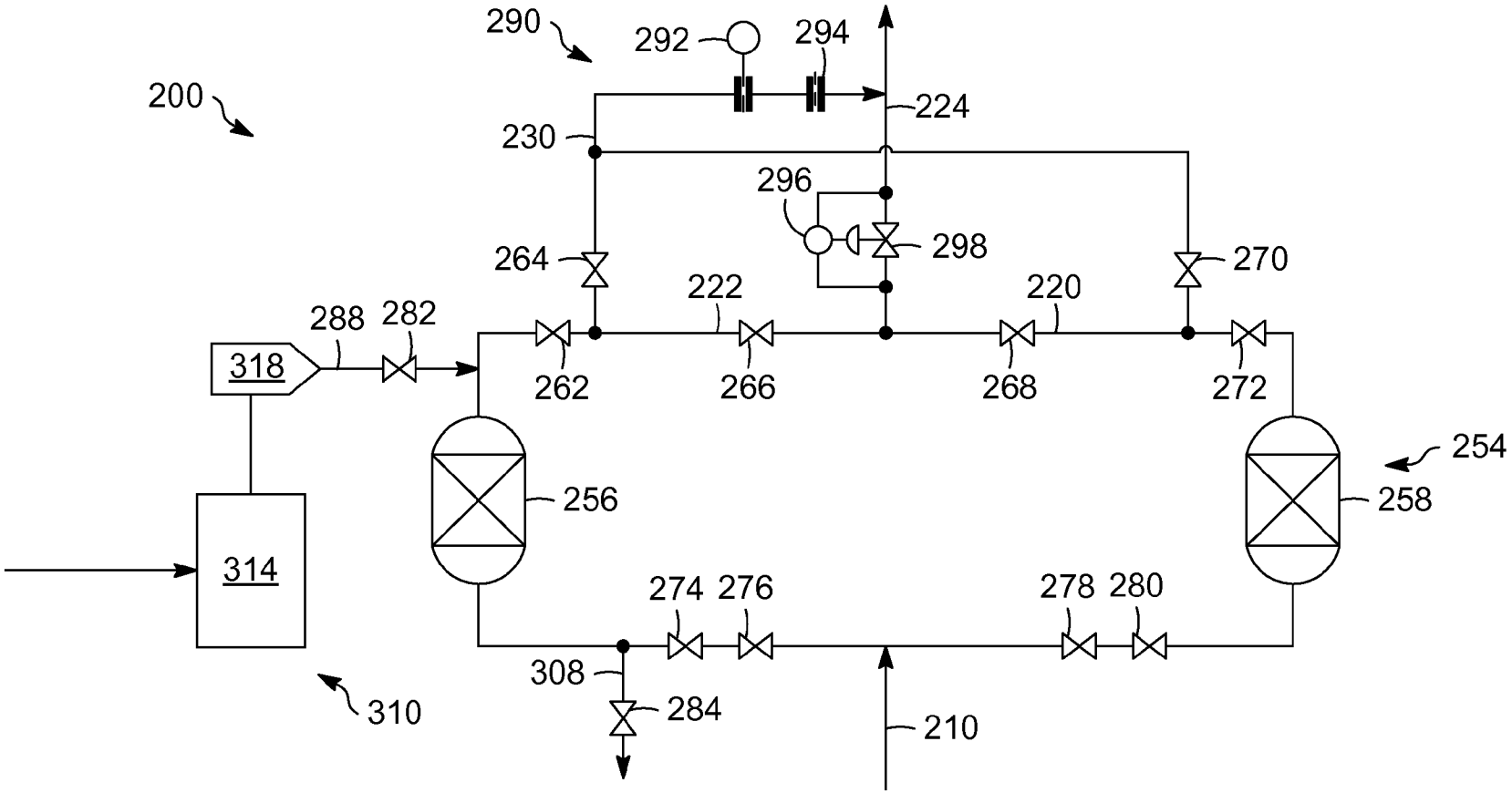
FIG. 2 is a schematic depiction of an exemplary first fluid drying unit.

Referring to FIG. 2, the first fluid drying unit 200 is depicted. The first fluid drying unit 200 can include at least one drier 254, one or more valves 260, a fluid tapering device 290, and a heater 310.

Preferably, the at least one drier 254 includes a first liquid drier 256 and a second liquid drier 258. The drier 256 and the drier 258 can be comprised in the liquid drying zone 250 as depicted in FIG. 1. Moreover, each drier 256 and the drier 258 can contain a molecular sieve where adsorption and/or absorption of water and other undesirable compounds, such as carbon dioxide and hydrogen sulfide, occurs and a respective internal drying zone or sub-zone. Generally, each drier 256 and 258 operates at a first condition to dry the hydrocarbon stream passing through the drier and a second condition to regenerate the drier. The driers 256 and 258 can be in series and regenerate alternatively with the other drier drying.

The one or more valves 260 can include a valve 262, a valve 264, a valve 266, a valve 268, a valve 270, a valve 272, a valve 274, a valve 276, a valve 278, a valve 280, a valve 282, and a valve 284. Various combinations of valves 260 can be opened and closed to direct process streams for conducting the first and second conditions and both driers in series.

In this exemplary embodiment, the fluid tapering device 290 can include a flow indicator 292, a restriction orifice 294, a pressure differential indicating controller 296, and a control valve 298. Particularly, the pressure differential indicating controller 296 can be in communication with the control valve 298, and the controller 296 and the control valve 298 are coupled to a line 224. In addition, the flow indicator 292 and the restriction orifice 294 can be coupled to a second line 230. The fluid tapering device 290 can regulate the flow of regenerant to dilute the regenerant with a dried liquid hydrocarbon downstream of a drying zone.

In addition, the heater 310 can include a steam heater 314 and a superheater 318 for heating the regenerant to operate at the second condition for regenerating a drier. Particularly, the steam heater 314 can be used to vaporize the regenerant before the superheater 318 brings the regenerant to a sufficient temperature to desorb water from the molecular sieve of the driers 256 and 258.

In one exemplary regeneration operation, the liquid hydrocarbon stream can be passed through a line 210 to the at least one drier 254. Typically, the liquid hydrocarbon stream enters one of the driers 256 and 258, as an example, the drier 258, and passing through valves 278 and 280 and into the drier 258 to have water removed. Afterwards, the dry liquid hydrocarbon stream can pass through the valves 272, 268, and 298 and through a line 224 to the reaction zone 170 of FIG. 1. Generally, while the liquid hydrocarbon stream is being dried in the drier 258, the valves 266, 270, 274, and 276 are closed while the valves 268, 272, 278, 280, and 298 are opened.

Meanwhile, the drier 256 can be regenerating. Generally, the regeneration is a multiple stage process using a liquid regenerant from the line 188 of FIG. 1, which may be passed to the heater 310. During regeneration, the regenerant may be heated in stages with the steam heater 314 and then with both the steam heater 314 and the superheater 318 until the regenerant can be of sufficient temperature to desorb the water from the molecular sieve. Generally, the regenerant passes through the steam heater 314 and the superheater 318 through a line 288 and the valve 282 to the top of the drier 256. Subsequently, the regenerant may pass through the drier 256, through a line 308, and the valve 284 before being cooled with e.g., a cooling water exchanger, to return to the isomerized product in the line 190 as depicted in FIG. 1. Typically, the valves 262, 266, 274, and 276 are closed.

Afterwards, the regenerant is slowly cooled by first turning off the superheater 318 and then the steam heater 314 while continuously passing the regenerant through the drier 256. Thus, the drier 256 and associated equipment can be cooled in stages to slowly ramp down the temperatures. At the end of the regeneration process, the drier 256 generally contains the liquid regenerant.

By using the liquid hydrocarbon stream, the used regenerant can be forced from the drier 256 through opened valves 262 and 264 to the line 230. The liquid regenerant may pass the flow indicator 292 and the restriction orifice 294 before entering the line 224. Meanwhile, the pressure differential indicating controller 296 in communication with the flow control valve 298 can indirectly regulate the pressure at the inlet of the drier 258. With the valves 274, 276, 262 and 264 open, the pressure differential indicating controller 296 can create a backpressure where the liquid hydrocarbon in the line 210 can also pass through the drier 256 to push the used regenerant through the valves 262 and 264 and through the flow indicator 292 and the restriction orifice 294. Generally, the restriction orifice 294 reduces the pressure and flow of the used regenerant so that it may enter the line 224 and dilute in the dried hydrocarbon liquid also passing through the line 224. The restriction orifice 294 can be sized to regulate the rate of the used regenerant flow. This rate can be calculated based on a desired period of time to ensure proper dilution of the regenerant without excessively delaying operations. Generally, the calculated rate is adjustable by a control system to satisfy operating conditions. This combined stream can then enter the reaction zone 170 without upsetting the reaction vessel or other operations occurring therein. Moreover, the diluted stream also minimizes upsets in the downstream fractionation zone 180. Once the regenerant is pushed out of the drier 256, the valve 264 can close, as well as valves 268, 272, 278, and 280, and flow can be passed through the regenerated drier 256 through the valves 262, 266, and 298 and the lines 222 and 224 to the reaction zone 170. Meanwhile, the drier 258 can be regenerated in a similar manner as the drier 256.

Although drying and regenerating of respective driers 258 and 256 are discussed herein, it should be understood that additional piping and/or valves can be included so that each drier 256 and 258 can operate in both conditions of drying and regenerating, and both driers in series. As an example, the driers 258 and 256 can be placed back in series operation with, e.g., the drier 256 in a lag position with respect to the drier 258, after regeneration.

Figure 3:
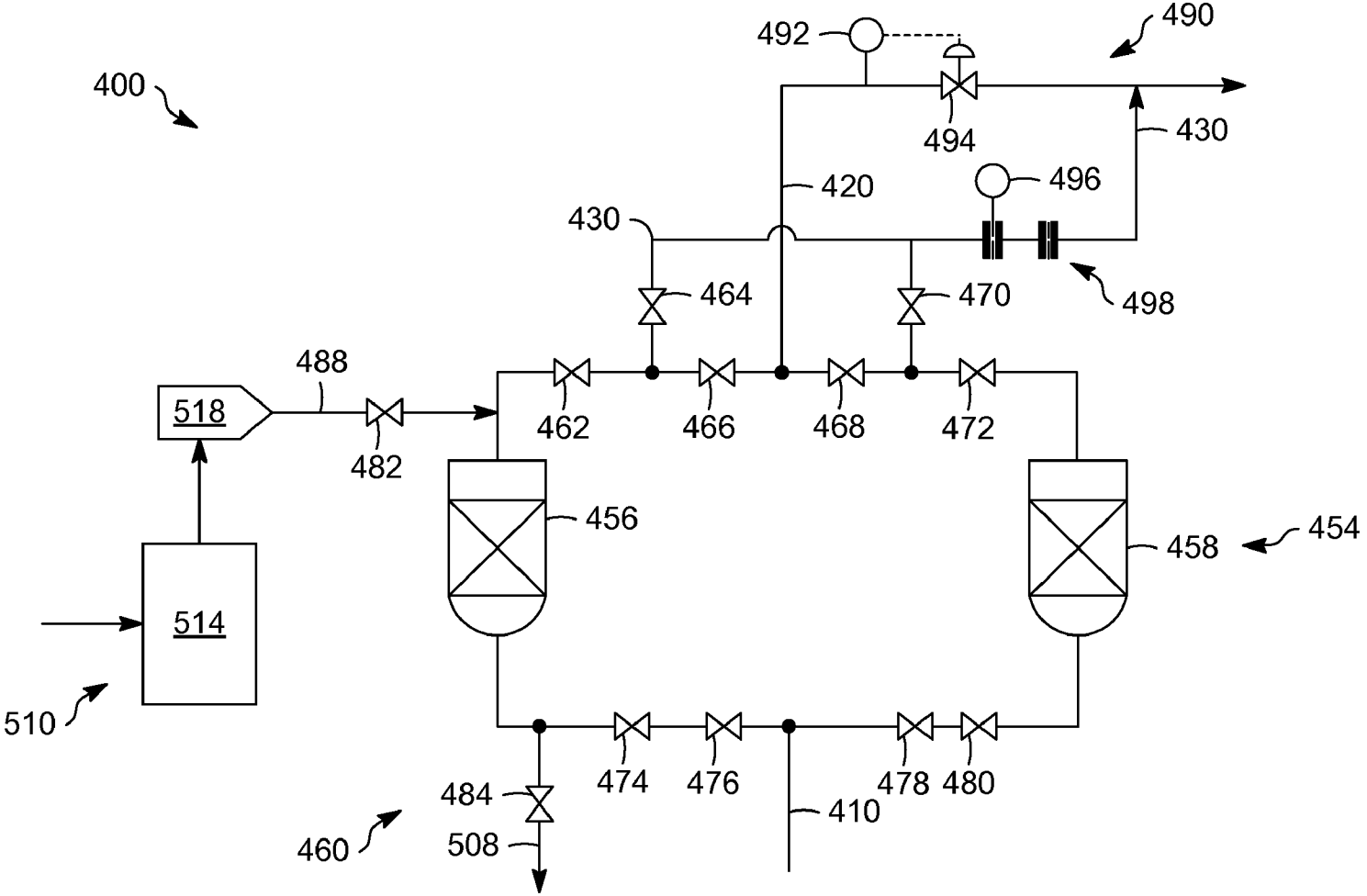
FIG. 3 is a schematic depiction of an exemplary second fluid drying unit.

Referring to FIG. 3, the second fluid drying unit 400 is depicted in FIG. 3. The second fluid drying unit 400 can be used to dry a gas stream, such as a gas stream rich in hydrogen. Usually, the second fluid drying unit 400 includes at least one drier 454, one or more valves 460, a fluid tapering device 490, and a heater 510.

Generally, the at least one drier 454 includes a first gas drier 456 and a second gas drier 458. The driers 456 and 458 can be comprised in the gas drying zone 450 as depicted in FIG. 1. Moreover, each drier 456 and 458 can contain a molecular sieve where absorption of water occurs and include a respective internal drying zone or sub-zone. Generally, each drier 456 and 458 operates at a first condition to dry the gas rich in hydrogen passing through the drier and a second condition to regenerate the drier. The driers 456 and 458 can be in series and regenerate alternatively with the other drier drying.

The one or more valves 460 can include a valve 462, a valve 464, a valve 466, a valve 468, a valve 470, a valve 472, a valve 474, a valve 476, a valve 478, a valve 480, a valve 482, and a valve 484. Various combinations of valves 460 can be opened and closed to direct process streams for conducting the first and second conditions.

In this exemplary embodiment, the fluid tapering device 490 can include at least one of a flow indicator 492, a flow control valve 494, a flow indicator 496, and a restriction orifice 498. Particularly, the flow indicator 492 can be in communication with the flow control valve 494, and the flow indicator 492 and the flow control valve 494 can be coupled to a first line 420. In addition, the flow indicator 496 and the restriction orifice 498 can be coupled to a second line 430. The heater 510 can include a steam heater 514 and a superheater 518.

In one exemplary regeneration operation, the gas, such as a gas rich in hydrogen, is typically introduced through a line 410. In this example, the drier 458 is in a first condition drying a fluid while the drier 456 is in the second condition being regenerated. As such, the gas can enter the line 410 and pass through valves 478 and 480 into the first drier 458, and the valves 474 and 476 may be closed. Typically, the valves 466 and 470 are also closed during drying of the gas in the drier 458. Afterwards, the dried gas can pass through the valves 472 and 468 and through the first line 420 to the reaction zone 170 as depicted in FIG. 1.

Meanwhile, the second gas drier 456 can be regenerating. Generally, the regeneration is a multiple stage process using a liquid regenerant from the line 188 of FIG. 1, which may be passed to the heater 510. During regeneration, the regenerant may be heated in stages with the steam heater 514 and then with both the steam heater 514 and the superheater 518 until the regenerant is of sufficient temperature to desorb water from the molecular sieve. Generally, the regenerant passes through the steam heater 514 and the superheater 518 through a line 488 and the valve 482, and to the top of the gas drier 456. Subsequently, the regenerant may pass through the drier 456, through the valve 484, and a line 508 before being cooled with e.g., a cooling water exchanger, to return in the line 190 as depicted in FIG. 1. Typically, the valves 462, 474 and 476 are closed.

Afterwards, the regenerant can be slowly cooled by first turning off the superheater 518 while continually passing the regenerant through the drier 456. Thus, the drier 456 and associated equipment can be cooled to slowly ramp down the temperatures. At the end of the regeneration process, the drier 456 generally contains the used regenerant as a gas.

By using the gas rich in hydrogen, the used regenerant can be forced from the drier 456 through the opened valves 462 and 464 and through the line 430. Particularly, the flow indicating controller 492 can adjust the flow of dried gas passing from the drier 456 to the reaction zone 170. This can create a backpressure and by opening valves 474, 476, 462, and 464, a portion of the gas rich in hydrogen can pass through the drier 456 to force the used regenerant through the line 430 towards the flow indicator 496 and the restriction orifice 498. The restriction orifice 498 can reduce the pressure and the flow of regenerant in the line 430 so that it is at a sufficiently low pressure to mix with the dried gas exiting the drier 458. This mixing can dilute the used regenerant so as to minimize upsets in one of more downstream operations, particularly in the reaction zone 170 and the fractionation zone 180. The restriction orifice 498 can be sized to regulate the rate of a used regenerant flow. This rate can be calculated based on a desired period of time to ensure proper dilution of the used regenerant without excessively delaying operations. After the preset time period, the used regenerant can pass from the second drier 458 to the reaction zone 170. At that time, operations can be switched by closing the valves 464, 468, 472, 478, and 480, and opening the valve 466 so that the drier 456 dries the gas. At this point, the drier 458 is in condition for regeneration.

Although drying and regenerating of respective driers 458 and 456 are discussed herein, it should be understood that additional piping and/or valves can be included so that each drier 456 and 458 can operate in both conditions of drying and regenerating, and series operation. As an example, the driers 456 and 458 can be placed back in series operation with, e.g., the drier 456 in a lag position with respect to the drier 458, after regeneration.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth uncorrected in degrees Celsius and, all parts and percentages are by mole, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for regenerating at least one drier for an apparatus for isomerizing a hydrocarbon stream rich in at least one hydrocarbon selected from the group consisting of at least one C4 hydrocarbon, at least one C5 hydrocarbon, at least one C6 hydrocarbon, and mixtures thereof, comprising:

A) regenerating the at least one drier wherein the at least one drier contains a used regenerant; and B) diluting the used regenerant downstream of the at least one drier over a period of time with a dried fluid comprising a gas rich in hydrogen to minimize upsets in downstream operations.

2. The process according to claim 1, wherein the dried fluid comprises a liquid rich in at least one hydrocarbon selected from the group consisting of at least one C4 hydrocarbon, at least one C5 hydrocarbon, at least one C6 hydrocarbon, and mixtures thereof.

3. The process according to claim 1, wherein the period of time is calculated to dilute the used regenerant with the dried fluid to minimize upsets in at least one of a downstream reaction zone and a fractionation zone.

4. A process for regenerating at least one drying zone for an apparatus isomerizing a hydrocarbon stream, comprising: diluting a used regenerant rich in at least one hydrocarbon selected from the group consisting of at least one C4 hydrocarbon, at least one C5 hydrocarbon, at least one C6 hydrocarbon, and mixtures thereof, downstream of the at least one drying zone over a period of time with a dried reactant fluid comprising a gas rich in hydrogen to minimize upsets in one or more downstream operations.

5. The process according to claim 4 wherein the dried fluid comprises a liquid rich in at least one hydrocarbon selected from the group consisting of at least one C4 hydrocarbon, at least one C5 hydrocarbon, at least one C6 hydrocarbon, and mixtures thereof.

* * * * *